US006582305B1

(12) United States Patent
Carter

(10) Patent No.: US 6,582,305 B1
(45) Date of Patent: Jun. 24, 2003

(54) BLACKOUT BINGO WITH WINNER DETERMINED BY DATE

(76) Inventor: Andrew Dennis Carter, 3473 W. 300 North, West Point, UT (US) 84015-7433

( * ) Notice: Subject to any disclaimer, the term of this patent is extended or adjusted under 35 U.S.C. 154(b) by 0 days.

(21) Appl. No.: 09/544,938

(22) Filed: Apr. 7, 2000

(51) Int. Cl.[7] ..... A63F 3/06
(52) U.S. Cl. ..... 463/19; 273/269
(58) Field of Search ..... 463/18, 19, 26, 463/27, 25, 16; 273/240, 269, 138.1, 138.2, 139; 705/14

(56) References Cited

U.S. PATENT DOCUMENTS 4,252,322 A * 2/1981 Orter ..... 273/269
5,265,880 A * 11/1993 Maksymec ..... 273/269
5,482,289 A * 1/1996 Weingardt ..... 273/269
5,564,700 A * 10/1996 Celona ..... 463/27
5,626,341 A * 5/1997 Jones et al. ..... 273/292
5,657,991 A * 8/1997 Camarato ..... 273/269
5,727,786 A * 3/1998 Weingardt ..... 273/269
5,743,800 A * 4/1998 Huard et al. ..... 463/26
5,823,534 A * 10/1998 Banyai ..... 273/269
5,851,011 A * 12/1998 Lott ..... 273/292
5,885,158 A * 3/1999 Torango et al. ..... 463/27
5,913,726 A * 6/1999 Jones et al. ..... 463/13
6,024,641 A * 2/2000 Sarno ..... 463/17

* cited by examiner

*Primary Examiner*—Mark Sager
*Assistant Examiner*—Steven Ashburn
(74) *Attorney, Agent, or Firm*—Thompson E. Fehr

(57) ABSTRACT

A modified method for playing bingo awarding a bonus prize to the first player who has all of the numbers on one of the player's cards selected if the number with which the player completes having all the numbers of that card selected is the same number as the day of the month on which the game is played. Optionally, the bonus prize available during a series of games only until there is a winner in that series of games. Also optionally, if no player wins the bonus prize in a given series of games, increasing the bonus prize in the subsequent series of games.

7 Claims, 2 Drawing Sheets

Prior Art

| B | I | N | G | O |
|---|---|---|---|---|
| 3 | 22 | 43 | 51 | 73 |
| 14 | 23 | 44 | 60 | 63 |
| 11 | 27 | FREE | 57 | 64 |
| 10 | 28 | 41 | 58 | 67 |
| 8 | 18 | 45 | 53 | 70 |

Figure 1

BLACKOUT BINGO WITH WINNER DETERMINED BY DATE

BACKGROUND OF THE INVENTION

1. Field of the Invention

This invention relates to a modified method for playing the game of bingo.

2. Description of the Related Art

The game of bingo traditionally consists of having players purchase one or more cards on which numbers are aligned in columns under each of the letters of the word bingo.

No number appears in more than one column.

No two cards have the same numbers arranged the same within the matrix.

Numbers are then randomly chosen. In the version of bingo most closely related to the present invention, which is termed "blackout bingo," the winner is the first player to have a card all of the numbers of which card have been chosen.

SUMMARY OF THE INVENTION

The Modified Method for Playing Bingo adds to the traditional game of blackout bingo the step that a bonus prize will be awarded if the final number chosen to have all the number on a player's card selected is the date of the month on which the game of blackout bingo is being played.

BRIEF DESCRIPTION OF THE DRAWINGS

FIG. 1 illustrates a sample of a bingo card.

DESCRIPTION OF THE PREFERRED EMBODIMENT

Figure 2:
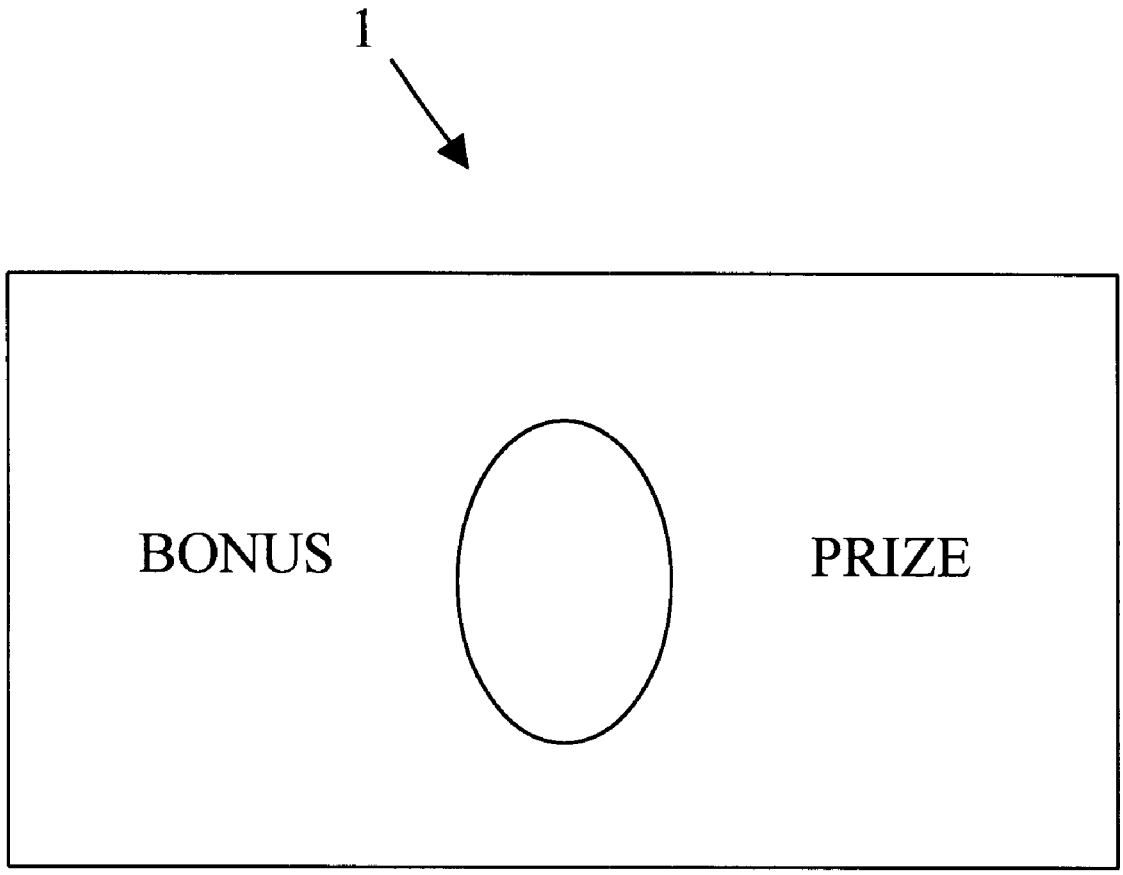
FIG. 2 shows a bonus prize.

The Modified Method for Playing Bingo of the present invention is played the same as blackout bingo except that the number with which the player completes having all the numbers on the player's card selected must be the same number as the day of the month on which the game is played. For example, if the game is being played on the tenth day of the month, the final number selected which completes all of the numbers of the winning player's card must be B10. (A letter precedes each number, but the letter is immaterial since the letter is the letter at the top of the column in which the number can exist and since no number can exist in more than one column.)

A game terminates when any player has all the numbers on a card selected. (The quantity of available numbers is such that some player will always succeed in having all the numbers on the player's card selected.) A standard prize is given to any player who is the first to have all the numbers on the player's card selected, even if the last number selected is not the date of the month on which the game is played. A bonus prize 1 is also awarded to the player if the last number selected is the date of the month on which the game is played.

If no one wins the bonus prize in a given series of games, preferably all the games played on a given day, the bonus prize is increased in the subsequent series of games.

Preferably, a player must pay a surcharge per card or per group of cards to be eligible for the bonus prize in the first game or series of games, preferably all the games played on a given day, for which that player is eligible to win the bonus prize. Also preferably, there will be a reduced surcharge per card for each subsequent game or series of games for which the player wishes to be eligible until the bonus prize has been won. Whenever a new player seeks eligibility for that player's cards, the full surcharge per card must be paid for the first game or series of games.

Once a player wins the bonus prize, no further bonus prize will be eligible within that series of games; and the bonus prize for the next series of games will return to the original bonus. Also, every player must pay the full surcharge for the first game or series of games after the bonus has been won.

Of course, each player must also pay a standard fee for the card or cards to be used in a game or series of games.

And not all games within a series of games are necessarily blackout games, but the bonus prize can only be won when the game is a blackout game.

I claim:

1. An improved method for playing bingo of the type having cards printed with numbers in columns of a matrix under the letters of the word bingo, having the same set of numbers arranged the same within the matrix on no two cards, distributing cards to players, randomly selecting certain of such numbers, designating as the winner the first player to have all the numbers on one of such player's cards to be selected who is also the first player to utter the word bingo after the last of such numbers is selected, and awarding a prize to the winner, wherein the improvement comprises:

awarding to the winner a bonus prize if the number with which the winner completes having all the numbers on the winner's card selected is the same number as the day of the month on which the game is played.

2. The method for playing bingo as recited in claim 1, further comprising:

having the bonus prize available during a series of games only until there is a winner in that series of games.

3. The method for playing bingo as recited in claim 2, further comprising:

if no player wins the bonus prize in a given series of games, increasing the bonus prize in the subsequent series of games.

4. The method for playing bingo as recited in claim 3, further comprising:

requiring that each player must pay a surcharge per card or per group of cards to be eligible to win the bonus prize in a first series of games; and requiring that each player who has paid the surcharge for a prior series of games during which no bonus prize was won must pay only a reduced surcharge to be eligible for the bonus prize in a subsequent series of games until the bonus prize has been won, after which each player must again play the full surcharge for the first series of games and the bonus prize for such first series will return to its original value.

5. The method for playing bingo as recited in claim 1, further comprising:

requiring that each player must pay a surcharge per card or per group of cards to be eligible to win the bonus prize in a first series of games; and requiring that each player who has paid the surcharge for a prior series of games during which no bonus prize was won must pay only a reduced surcharge to be eligible for the bonus prize in a subsequent series of games until the bonus prize has been won, after which each player must again pay the full surcharge for the first series of games and the bonus prize for such first series will return to its original value.

6. The method for playing bingo as recited in claim 5, further comprising:

having the bonus prize available during a series of games only until there is a winner in that series of games.

7. The method for playing bingo as recited in claim 6, further comprising:

if no player wins the bonus prize in a given series of games, increasing the bonus prize in the subsequent series of games.

* * * * *